United States Patent [19]

Erickson

[11] 4,125,262

[45] Nov. 14, 1978

[54] GAME WITH ELASTIC TETHERED MISSILES

[75] Inventor: Erick E. Erickson, Chicago, Ill.

[73] Assignee: Marvin Glass & Associates, Chicago, Ill.

[21] Appl. No.: 815,802

[22] Filed: Jul. 15, 1977

[51] Int. Cl.[2] ..... A63F 1/04; A63B 63/04; A63B 67/10

[52] U.S. Cl. ..... 273/101; 273/95 A; 273/255; 273/289; 273/102 AP

[58] Field of Search ..... 273/95 A, 97 R, 98 R, 273/101, 119 R, 58 C, 26 E, 134 AC, 262

[56] References Cited

U.S. PATENT DOCUMENTS

| | | | |
|---|---|---|---|
| 286,570 | 10/1883 | Sweeten | 273/97 R |
| 567,218 | 9/1896 | Butler | 273/136 E |
| 997,314 | 7/1911 | Moore | 273/119 R |
| 1,212,698 | 1/1917 | Sharp | 273/98 |
| 1,223,859 | 4/1917 | Doan | 273/101 |
| 1,781,717 | 11/1930 | Bradt | 273/102.1 R |
| 3,362,715 | 1/1968 | Hartpence | 273/134 AC |
| 3,860,241 | 1/1975 | Leftin | 273/134 AC |
| 4,059,271 | 11/1977 | Dupre | 273/95 A |

FOREIGN PATENT DOCUMENTS

| | | | |
|---|---|---|---|
| 218,510 | 3/1908 | Fed. Rep. of Germany | 273/97 R |
| 6,591 of | 1888 | United Kingdom | 273/136 E |
| 1,185,805 | 3/1970 | United Kingdom | 273/134 AC |

*Primary Examiner*—William H. Grieb
*Assistant Examiner*—Lawrence E. Anderson
*Attorney, Agent, or Firm*—Mason, Kolehmainen, Rathburn & Wyss

[57] ABSTRACT

An action strategy game device includes a base having a playing surface defining a plurality of play areas on opposite sides for supporting one or more playing pieces of opposing players. A plurality of playing pieces are adapted for movement around the play areas between a back line and a front line thereof toward an opposing player's area are provided and the playing pieces normally stand upright on the base until knocked down when struck by a moving missile or cannon ball released or fired by an opposing player. Cannon balls are provided for firing along paths determined by the players and reaimed to knock down an opponent's upstanding playing pieces. The cannon balls are secured to one end of an elongated elastic member such as a rubber band which is securable to the base of the game device between the play areas. A notched wall structure is provided along the back line of each player for holding the cannon balls in place at selected positions along the back line with the elastic member under tension. A manually transportable device is provided for releasing the cannon balls by movement upwardly to clear the wall structure so that they are propelled by the elastic member toward an upstanding playing piece on an opponent's play area.

18 Claims, 7 Drawing Figures

Fig 1
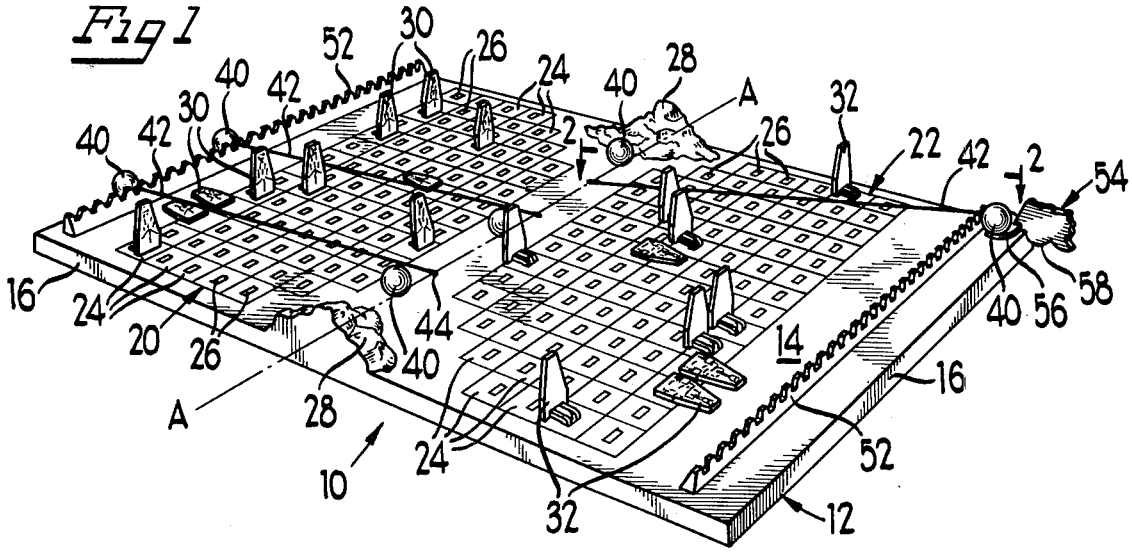
Fig 2
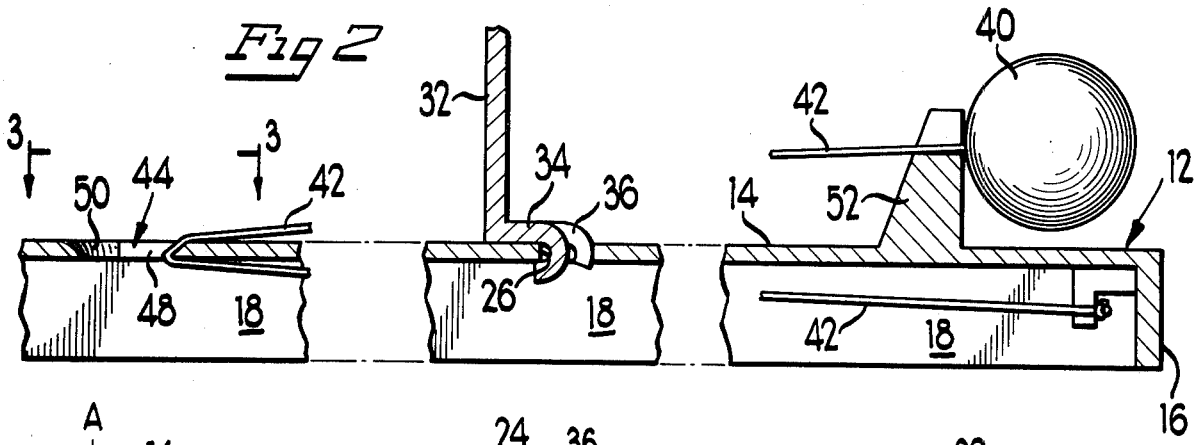
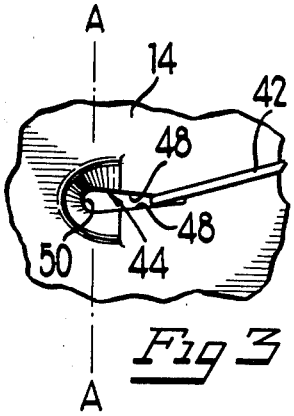
Fig 3
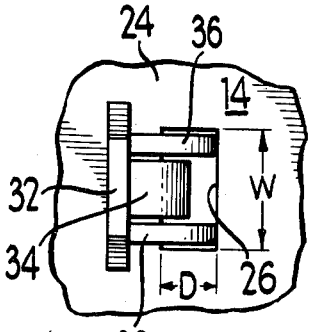
Fig 4
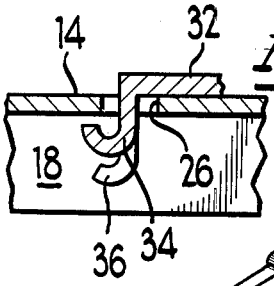
Fig 5
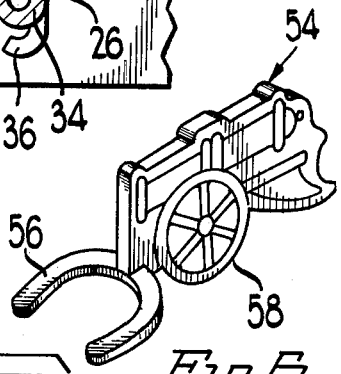
Fig 6
Fig 7
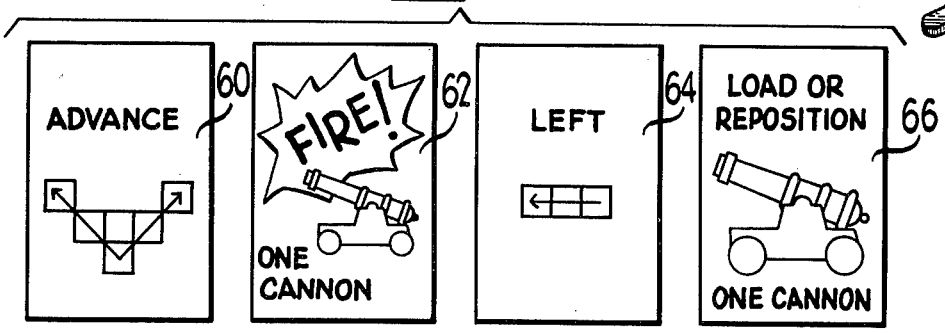

GAME WITH ELASTIC TETHERED MISSILES

BACKGROUND OF THE INVENTION

1. Field of the Invention

The present invention relates to a new and improved action strategy game device designed for two players. In playing the game in accordance with the invention, each player develops a strategy for maneuvering his playing pieces with the object of successfully attacking or defending an area on the game board representing or designated as a beach head. Each player attempts to knock down the playing pieces of his opponent with cannon fire which is simulated by aiming and releasing cannon balls or missiles which are propelled by an elastic band which is held under tension until released. Chance means is provided for directing the play of the game including the movement of playing pieces, aiming and firing of cannon balls and reloading.

2. Description of the Prior Art

Many game board devices have been developed which require strategic maneuvering of playing pieces over a play area with the object of attacking or defending a particular area by capturing and thereby eliminating the playing pieces of an opponent in accordance with the rules of the game. The well known games of chess and checkers are examples of such prior art strategically oriented games.

The present invention involves the development of a strategy game with a game board device which provides for strategy in maneuvering of the playing pieces and also includes physical action type devices wherein the opponents aim and fire missiles or cannon balls at the playing pieces of their opponents to knock the playing pieces down and thereby eventually eliminate or reduce the opponent's forces and win the game. The game is also won when one player reaches the front line with a selected number of pieces before his opponent does. Thus, the action strategy game device of the present invention requires both mental ability as well as physical ability to play. This is quite different from games which often require only strategy or mental activity or a purely physical action game where little or no mental activity is required.

SUMMARY OF THE INVENTION

It is an object of the present invention to provide a new and improved action strategy board game for amusement of two players. More particularly, it is an object of the invention to provide an interesting and fascinating game which requires both strategy or mental activity in addition to and coupled with physical ability.

The foregoing and other objects and advantages of the present invention are accomplished in an illustrated embodiment which comprises an action strategy game with a game board having a base defining a playing surface with a pair of play areas on opposite portions designated as land and sea areas and adapted for supporting one or more playing pieces of the opposing players. A plurality of such playing pieces are adapted for strategic movement and placement on the respective play areas between a back line and a front line adjacent the area of an opposing player. The playing pieces normally stand upright on the base and are manually movable to different spaces on the play areas. If a playing piece is struck by a moving missile released by an opposing player, the playing pieces may be knocked down and is thus eliminated from further use in the game. At least one missile or cannon ball is provided and is adapted to be propelled and aimed along a path determined by a player so that when it is released it is forcefully propelled by the tension force of an elastic member toward an opponent's play area. The elastic member such as a rubber band is secured to a cannon ball at one end and is securable to the base of the game at a position between the play areas until the cannon ball is fired. A notched wall is provided on the base along the back line of each player for aiming and holding the cannon balls while the elastic member is under tension ready to be fired. A release or filing device resembling a cannon is provided so that players may fire the cannon balls toward the upstanding playing pieces of an opponent in the opposite play area. A chance device such as a deck of cards is utilized for randomly selecting the order in which the players may advance and/or move their playing pieces and when they may aim and position the missiles or cannon balls and fire them at the opponent's playing pieces to provide the best strategic attack posture. The game is won when all of the playing pieces of one player have been knocked down by cannon balls fired by the player or an opposing player or when a selected number (such as three of a player's pieces reach the frong line without being knocked down). After a cannon ball is fired, the associated elastic member returns the cannon ball to a center position on the game board and the cannon ball can then be reloaded, aimed and fired.

BRIEF DESCRIPTION OF THE DRAWINGS

For a better understanding of the present invention, reference should be had to the following detailed description taken in conjunction with the drawings, in which:

FIG. 1 is a perspective view illustrating an action strategy game board device constructed in accordance with the features of the present invention and illustrated as the game is in position during play;

FIG. 2 is a fragmentary cross-sectional view of the game device of FIG. 2 taken substantially along lines 2—2 of FIG. 1;

FIG. 3 is a fragmentary, top plan view of the base or game board of the device looking in the direction of arrows 3—3 of FIG. 2;

FIG. 4 is a fragmentary, top plan view of a playing piece used in the game and shown in an upright or standing position on the base or game board playing surface;

FIG. 5 is a fragmentary, vertical sectional view taken at the central or mid portion of FIG. 2 and illustrating the playing piece in a flat or knocked down position after it has been struck with a cannon ball;

FIG. 6 is a perspective view of a cannon ball firing or releasing device which is adapted to be manually positioned and operated with the game board in accordance with the features of the present invention;

FIG. 7 indicates the faces of cards which are used by the players during the game to provide randomly selected actions in playing the game in accordance with the rules.

DESCRIPTION OF THE PREFERRED EMBODIMENT

Referring now to the drawings, and in particular, FIG. 1, therein is illustrated a new and improved action strategy game constructed in accordance with the features of the present invention and indicated generally by the reference numeral 10. The game includes a game board 12 having a generally rectangular upper playing surface 14 preferably formed of plastic or other suitable material and having a down turned peripheral edge or skirt 16 which forms a hollow enclosure 18 beneath the underside of the playing surface as best illustrated in FIG. 2.

The playing surface 14 of the game board structure 12 is divided generally in half by a transverse axis A—A (FIG. 1) and a first playing area 20 is defined on one half of the playing surface representing a sea or ocean from which an attack may be made against a playing area 22 on the opposite side of the dividing axis which represents a beach head or land area. Each of the land and sea play areas on the playing surface are divided into a plurality of rectangular or square spaces 24, and each space is provided with a square or rectangular slot 26 defined therein as illustrated. At the opposite ends of the central axis A—A, the playing surface 14 is provided with a pair of upstanding mountains or hills 28 which simulate geographical features of the battle area between the land and sea. The playing spaces 24 on the land and sea areas are differently colored to make the battle setting more realistic.

In accordance with the present invention, a player who is attacking from the sea is provided with a plurality of playing pieces 30 which are colored in an appropriate color such as blue indicating they are to be used on the blue play area 20 representing the area. In an embodiment of the action strategy game device of the present invention, a total of ten playing pieces 30 are provided for the player attacking from the sea and the front face of each playing piece is decorated with a picture or indicia representing a sea-going war vessel or the like. The player on beach head or land area 22, the opposite half of the playing surface 14, is provided with a similar number of playing pieces 32 which may be identical in form or structure to the playing pieces 30 but which are colored differently, for example, red. These playing pieces on the land or beach head have a picture or indicia on the front faces such as a cannon or other piece of armour such as a tank which may be used to fire at the vessels represented by the indicia on the opposing playing pieces 30.

Because the playing pieces 30 and 32 in each set are identical in form, only the land based playing piece 32 is illustrated and described in detail. The playing pieces include an upstanding portion of generally trapezoidal shape with a front face on which the identifying indicia or picture in the form of a decal or molded-in design is provided.

Each playing piece includes a rearwardly extending, centrally disposed foot portion 34 having a downwardly curved outer end which is adapted to curve below and engage the underside of the playing surface 14 when the foot portion 34 is inserted into one of the rectangular slots 26 of a playing space 24. On either side of the central foot portion 34 each playing piece is formed with a pair of narrow fingers 36 which extend outwardly beyond and which are adapted (as shown in FIG. 2) to engage the rearward edge of a slot 26 when the playing piece is in an upright or standing position. As illustrated in FIGS. 2, 4 and 5 when the front face of a playing piece is struck by a cannon ball the playing piece is pivoted or knocked down to a flat position as shown in FIG. 5. The slots 26 in the playing spaces on the game board are dimensioned with a width "W" which is slightly greater than the distance between the opposite outside surfaces of the fingers 36. This arrangement prevents the playing piece from moving in a lateral direction when a cannon ball strikes the front face of the playing piece at an angle or an off center position.

The playing pieces are movable from space to space in the land and sea playing area by first pivoting the playing pieces downwardly to the flat position (as shown in FIG. 5), moving them rearwardly and then withdrawing or lifting the foot portion 34 and fingers 36 vertically upwardly out of the slots 26 which are dimensioned with a depth (indicated by the letter "D", FIG. 4) slightly larger than the curved end portion of the foot 34. The playing pieces are positioned at selected different playing spaces 24 on the board and are easily erected into the standing position to remain as shown in FIG. 2 with the lower end portion of the foot 34 curved under and engaged with the underside of the game board playing surface 14. In this position, the rearward end surface of the curved fingers 36 engages the rear edge of the slot 26 to prevent rearward translation of the playing piece when struck with a cannon ball. It will thus be seen that the playing pieces 30 and 32 of the respective players may be manually maneuvered around the playing areas from space to space and normally are maintained in an upright position when occupying a space until such time as they are hit and knocked down to the flat position of FIG. 5 by a cannon ball fired by an opposing player.

In accordance with the present invention, each player is provided with a number of spherical cannon balls or missiles 40 for use in firing at an opponent's playing pieces. Missiles 40 are colored appropriately such as blue and red for the respective sea and land areas and each is connected to an elongated elastic member 42 such as a rubber band or the like for propelling the cannon ball when released to strike down an opponent's playing piece. As illustrated in FIG. 2, the upper end portion of an elastic band is connected to each cannon ball 40 and extends therefrom toward a specially shaped opening 44 which is defined in the board 12 on the central axis A—A or middle portion of the game board playing surface 14. In the illustrated embodiment three cannon balls 40 are provided for each player and accordingly, three shaped openings 44 are provided for each player at alternately spaced intervals on the dividing center axis represented by the imaginary line A—A. When the elastic rubber bands 42 are under tension, ready for firing the appropriately colored cannon balls 40 and an upper portion of each elastic band extends between the cannon ball and passes downwardly therefrom through an associated especially shaped opening 44 into the hollow space 18 below the game board playing surface 14. The lower portion of the elastic band extends back from the opening below the playing surface as shown and is fixedly secured at its outer end to an integrally formed bracket formed on the underside of the playing surface. The shaped openings 44 are formed with a pair of convergent vertical wedge surfaces 48 which engage and pinch the elastic band 42 to hold them under tension. At the outer ends of the divergent wedge surfaces 48 the shaped opening 44 transitions to an enlarged open area 50 having downwardly and inwardly sloped walls and formed a semi-circular shape as shown in plan view in FIG. 3. The enlarged open area is larger in area than the transverse cross-section of the elastic band 42 so that when a cannon ball 40 is released to be propelled by the tension force of the elastic member, the rubber band moves out of its wedging or pinching engagement with the surface 48 and is freed in the open area 50. This arrangement provides for return of the cannon balls 40 to a position at the center axis A—A on the board after they have been fired. Remaining tension on the elastic members 42 retains the cannon balls in position on the center axis A—A over the shaped openings 44 as illustrated, until such time as the cannon balls are reloaded or repositioned ready to be fired again.

In accordance with the invention, each player is provided with an upstanding, integrally formed notched wall structure 52 along the back line of his respective play area for retaining or holding the cannon balls 40 in ready position with the lands 42 in tension ready to propell or fire the cannon as shown in FIG. 2. The respective notches along the walls 52 permit the angular adjustment of the rubber bands 42 on the game board so that the intended path of the cannon balls can be selected and aimed to hit an opponent's playing piece on the opposite side of the center axis A—A.

In order to release or fire a cannon ball 40 toward an opponent's area, each player is provided with a movable firing element 54 which is decorated as a cannon as shown in FIG. 6. The cannons are formed with a horseshoe shaped lift fork 56 at the front end for engaging the underside of a cannon ball to elevate the cannon ball up to a level wherein the underside of the ball clears the upper edge of the notched wall structure 52. When this occurs, the ball is released and the tension force of the rubber band 42 propells the ball forcefully to knock down an opponent's playing pieces. The cannons also include a circular segment 58 on the underside, which segment is adapted to engage and bear against the edge of the playing surface 14 causing the fork 56 to raise when the cannon is pivoted downwardly at the rear to fire a cannon ball. When the cannon balls 40 are accurately aimed and strike the front face of an opposing playing piece, the playing pieces are knocked down to the flat position as shown in FIG. 5 and subsequently the remaining tension force of the elastic band 42 causes the cannon ball to rebound toward the center line of the playing surface 14 represented by the inaginary axis A—A. The balls are retained above their respective shaped opening 44 by the remaining tension in the bands 42 until reloading by moving the balls to the position of FIG. 2 by placing the cannon ball behind the notched wall structure 52. This or course stretches the rubber band ready to fire the ball and the choice of a particular notch on the wall determines the direction of the shot.

It should also be noted that the interlocking support arrangement between the feet 34 and the fingers 36 of the playing pieces permits a knock down of a playing piece only when the playing piece is struck on the front surface and not on the back side. Accordingly, a player releasing a cannon ball inadvertently will not known down his own playing pieces and when a cannon ball rebounds toward the central axis A—A after being fired, it will not knock down the playing pieces from the back side on the return stroke.

Random means such as a deck of cards (FIG. 7) is provided for directing the order of play in the game. A group of "Advance" cards 60 in the deck are provided to permit a player to advance his playing pieces toward his areas front line adjacent the center axis A—A. A plurality of "cannon firing" cards 62 permit a player to release or fire a cannon ball 40 toward the playing pieces of an opponent and some of these fire cards are designated to permit more than one cannon ball to be fired in a turn. A plurality of "left" or "right" cards 64 are provided in the deck to permit a player to laterally move his playing pieces a selected number of spaces and a plurality of "load" or "reposition" cards 66 permit a player to reposition or aim a cannon ball by selection of an appropriate notch along the holding wall structure 52. By placing a band 42 in a different notch different angular relations are provided. To reload a cannon ball that is positioned at the center line A—A over its associated shaped opening is picked up and moved to a firing position behind the holding wall 52 in an appropriate notch.

The play area 20 designated as the "ocean" or "sea" is colored blue and the land or beach head area 22 is colored red and a total of six cannon balls 40 are provided, three of them being red for use only by a player defending the beach head area, and three being blue to be used only by the player attacking from the sea. Each player is provided with ten playing pieces 30 or 32 respectively, which pieces are colored appropriately red and blue and when the playing pieces are knocked down two of the playing spaces 24 are blocked so that other playing pieces may not be moved into either the blocked playing spaces. This of course makes moving the pieces more difficult. Initially, the cannon balls 40 of each player are alternately spaced along the center axis represented by the imaginary line A—A and in this position the elastic bands 42 extend downwardly through the shaped openings 44 and are secured under slight tension to the retaining brackets 46 on the underside of the board structure.

An appropriately colored cannon 54 is provided for each player and a deck numbering 44 cards is utilized in playing the game. The "advance" cards 60 permit the player to follow either arrow, a selected number of spaces as indicated and the "right" or "left" cards 64 are treated similarly. The "load" or "reposition" cards 66 permit the players to move the cannon balls from the position on the center axis A—A back behind the notched rails 52 with the lands 42 in a selected notch as desired but these cards do not permit the balls to be fired at that time. The cards may have instructions permitting more than one cannon ball to be loaded or repositioned in one turn. The "load" or "reposition" cards may also be utilized for reaiming a cannon ball by movement of the land 42 to a different notch on the notched wall. The "cannon fire" cards 62 allow a player to release or propell a cannon ball toward their opponents area and a number indicated on the card may permit more than one cannon ball to be fired in a turn. One or more surprise attack cards are provided to permit a player to aim and fire a cannon ball in the same turn and one or more "disarm opponent" cards is provided permitting a player to eliminate the pressure of an opponent's loaded and aimed cannon facing one of his own playing pieces. When the "disarm opponent" cards is played, the player removes the cannon ball from its loaded position adjacent the notched wall 52 and returns the ball to a position on the center line A—A of the playing surface.

In preparation for the game, the players first decide who will attack from the sea area 20 and who will defend the beach head area 22. The players then arrange their appropriate playing pieces 30 and 32 along the back row of spaces 24 in their respective play areas. Because there are more spaces in this row than there are playing pieces, some open spaces will be provided so that the player's own cannon balls can be fired through these open spaces toward the playing pieces of an opponent. After shuffling the deck, five cards are delt to each player and the remainder of the deck is placed in a draw pile on the board surface face down. As the cards are played, they are discarded on the opposite side of the board in a discard pile face up. The player who is attacking from the sea 20 starts the play by playing any one card in his hand and then laying it face up on the board to start the discard pile. The player may play any of the cards in his hand as desired in accordance with his own strategy. After one player moves he then draws another card from the draw pile to maintain the number of cards in his hand at five. After all of the cards in the deck have been used, the discard pile is reshuffled and play continues. The winner of the game is determined by the first player to get three of his playing pieces to his front line (i.e. row of spaces closest to the center line designated A—A). If neither player has three pieces left to do this, the player having the most pieces on his front line is victorious. Each of the play areas is provided with a pair of spaces 24 designated as safe zones on the front line. These areas are called "bunkers" on the beach head or land portion and are designated as "ribbed piers" of the sea or ocean portion. The players strategically maneuver to get their first two playing pieces into these safe zones on the front line and then attempt to move a third piece to the line to win the game.

The game then thus provides mental as well as physical action and is extremely interesting and fun to play.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A game device comprising:

a base providing a playing surface defining a plurality of play areas on opposite portions for supporting one or more playing pieces of an opposing player, said base including an opening spaced between said play areas;

a plurality of playing pieces adapted for movement around said play area between a back line thereof and a front line adjacent the area of an opposing player, said playing pieces normally standing upright on said base and movable to a knocked down position when struck by a moving missile released by an opposing player;

at least one missile adapted to move along a path determined by the player for striking and knocking down the playing pieces of opposing players;

an elongated elastic member secured at one end to said missile and securable to said game device between said play areas, said elastic member extending through said opening and said opening of said base shaped to include wedging surfaces for retaining tension on said elastic member when extended toward said missile holding means of one player;

missile holding means on said base along the back line of each player area for temporarily holding said missile in place at a selected position along said back line with said elastic member under tension, said missile holding means including a wall member along said back line projecting upwardly of said base and formed with a plurality of notches therein for said elastic member, whereby said elastic member can be angularly adjusted on said base by placement in a selected notch to align said elastic member with a playing piece of an opposing player; and means for releasing said missile from said holding means to be propelled by contraction of said elastic member toward an upstanding playing piece in an opponent's play area.

2. The game device of claim 1 wherein said missile release means comprises a lifter selectively positioned along said wall member and manually operable to elevate said missile to clear said wall member and move toward an opponents play area under the propelling force exerted by the tension of said elastic member.

3. The game device of claim 1 including chance means for directing players to move a playing piece on said base.

4. The game device of claim 1 including means for directing the release of a missile from said holding means by a player.

5. The game device of claim 1 including means directing a player to reposition said elastic member into a different notch of said wall member.

6. The game device of claim 1 wherein said play areas of said base each include a plurality of playing spaces to be selectively occupied by a playing piece moved thereto by a player.

7. The game device of claim 6 including chance means for directing players to move a playing piece to a different space on a play area.

8. The game device of claim 1 wherein said opening is shaped to include a portion large enough to accommodate said elastic member without retaining tension thereon when said missile releasing means is actuated by a player and said elastic member extends away from said missile holding means.

9. The game device of claim 8 wherein said opening is generally keyhole shaped.

10. The game device of claim 1 wherein said elastic member includes an opposite end secured adjacent an underside of said base.

11. The game device of claim 10 wherein said elastic member is of a length whereby said missile secured adjacent one end is returned by tension of said elastic member to a position adjacent said opening in said base after said missile has been released from said holding means by a player.

12. The game device of claim 11 including chance means for permitting a player to move a missile from said position adjacent said opening into a selected position along said holding means with said elastic member under tension ready to propell said missile when released.

13. The game device of claim 6 wherein at least some of said spaces are formed with a slot therein and at least some of said playing pieces include a tongue extendable into said slots.

14. The game device of claim 13 wherein said tongue is interlockable in a slot to prevent displacement of said playing piece in one direction when struck by a missile yet permit displacement in a direction transverse thereto.

15. The game device of claim 14 wherein said tongue engaged in a first position in a slot includes means for maintaining said playing piece in an upright position.

16. The game device of claim 15 wherein said tongue is displaceable in said slot to a second position permitting said playing piece to pivot downwardly to a flat position on said base when struck by a missile released by an opposing player.

17. The game device of claim 13 wherein said tongue is dimensioned to fit into a slot only when said playing piece is in a selected relationship with said base.

18. The game device of claim 17 wherein said selected relationship is a flat position of said playing piece parallel of said base.

* * * * *